United States Patent [19]

Nicodemus et al.

[11] Patent Number: 4,776,115

[45] Date of Patent: Oct. 11, 1988

[54] SNOW PLOW BLOCKING UNIT

[76] Inventors: Ronald P. Nicodemus, 506 E. Lloyd St., Ebensburg, Pa. 15931; Thomas Knecht, P.O. Box 3, Stoystown, Pa. 15563

[21] Appl. No.: 131,743

[22] Filed: Dec. 11, 1987

[51] Int. Cl.[4] ..... E01H 5/04

[52] U.S. Cl. ..... 37/231

[58] Field of Search ..... 37/231, 234, 270; 172/272, 275; 280/460 R, 186; 414/723

[56] References Cited

U.S. PATENT DOCUMENTS

| | | | |
|---|---|---|---|
| Re. 22,991 | 3/1948 | Hitchcock et al. | 414/460 X |
| 2,950,123 | 8/1960 | Nearman | 414/460 X |
| 3,044,567 | 7/1962 | Reed et al. | 414/460 X |
| 3,104,893 | 9/1963 | Torrey . | |
| 3,380,820 | 6/1968 | Lebre | 414/460 |
| 3,391,905 | 7/1968 | Burns | 414/460 X |
| 3,470,631 | 10/1969 | Grimes | 37/231 |
| 3,511,522 | 5/1970 | Hansen et al. | 172/272 |
| 3,805,980 | 4/1974 | Kisaka | 214/131 A |
| 3,851,894 | 12/1974 | St. Pierre | 280/460 R |
| 3,987,562 | 10/1976 | Deen et al. | 37/42 R |

*Primary Examiner*—E. H. Eickholt

*Attorney, Agent, or Firm*—Webb, Burden, Ziesenheim & Webb

[57] ABSTRACT

A snow plow blocking unit for fastening and removing a snow plow from a truck or other vehicle, the snow plow of the type having a connecting bracket that attaches to the truck or other vehicle. The snow plow blocking unit includes a platform, a raising and lowering apparatus for raising and lowering the platform, a sideward moving apparatus for moving the platform in a lateral direction, and a stop positioned forwardly and at a predetermined distance of the platform. The stop cooperates with the truck or other vehicle whereby the truck or other vehicle is positioned a distance from the platform so that when the snow plow is detached from the truck or other vehicle the connecting bracket of the snow plow is received on the platform by adjusting the raising and lowering apparatus and the sideward moving apparatus. Likewise, when the connecting bracket of a detached snow plow is attached to a truck or other vehicle the connecting bracket is aligned with the truck or other vehicle by adjusting the raising and lowering apparatus and the sideward moving apparatus.

14 Claims, 6 Drawing Sheets

SNOW PLOW BLOCKING UNIT

BACKGROUND OF THE INVENTION

1. Field of the Invention

This invention relates generally to snow plows of the type that normally attach to the front of a truck or other vehicle and, more particularly, to a snow plow blocking unit for use in attaching and dismounting snow plows to trucks or vehicles.

2. Description of the Prior Art

Standard snow plows, such as the type used by highway maintenance crews, are rather cumbersome to attach to trucks or other vehicles (hereinafter referred to as "trucks"). Usually during the summer months these trucks carry asphalt, gravel or the like and during the winter months carry road salt and have snow plows attached thereto. Typically, each snow plow includes a snow plow blade and a snow plow push frame with the snow plow push frame being three or more feet wide and weighing several hundred pounds. To attach the snow plows at least two individuals are required to align and pin the snow plow with the front end of a truck. An additional person is then required to drive the truck. Back injuries are not an uncommon occurrence to the individuals who align these snow plows with their respective trucks, due to the lifting and moving of these heavy objects. Furthermore, such a procedure is rather time consuming and can require as much as 20–30 minutes to complete.

Accordingly, it is an object of our invention to provide a snow plow blocking unit that requires only one individual to attach a snow plow to a truck with a minimal amount of physical effort.

In an emergency situation, such as a sudden snow storm, this labor intensive operation of attaching the snow plow to a truck can delay a fleet of trucks from clearing the roads of snow since usually only a few individuals are available to attach the snow plows. Furthermore, these workmen tend to get fatigued as they continue to attach many of these snow plows in a short period of time. Thus, even though the drivers, the trucks, and the snow plows are available to clear the snow covered roads in an emergency situation, it will usually take several hours to attach the snow plows to all of the trucks.

Accordingly, it is a further object of our invention to provide a snow plow blocking unit which can quickly align a snow plow with a truck or other vehicle so that the snow plow can be attached thereto.

Prior inventions have attempted to aid in the attachment of a plow or similar attachment to a truck. One such method is to modify the plow and/or bracket which attaches to the truck, such as shown in U.S. Pat. No. 3,851,894 to St. Pierre, U.S. Pat. No. 3,104,893 to Torrey and U.S. Pat. No. 3,987,562 to Deen et al. Although such devices enable quick and easy attachment, special modifications are required to the plow and truck chassis and the plows must still be manually aligned as described above.

Another object of our invention is to provide a snow blocking unit which does not require any additional modification to the snow plow or truck so that the snow plow can quickly and easily be attached thereto.

Other prior inventions have utilized temporary vertically adjustable stands to support the plow or other implements at various elevations to ease in their attachment to a truck, such as shown in U.S. Pat. No. 3,805,980 to Kisaka. Even with such stands lateral adjustment and prior positioning of the vehicle is time consuming and typically will require two individuals to efficiently and quickly attach the plow or other implement to the truck.

It is a feature of our invention to position properly the truck with respect to the snow plow by the use of a wheel guide and wheel stop so that the snow plow can quickly and easily be attached to the truck.

Other objects of the invention together with the advantages which are pertinent thereto will appear during the course of the description.

SUMMARY OF THE INVENTION

We have invented a snow plow blocking unit for fastening and removing a snow plow from a truck or other vehicle. The snow plow has a connecting bracket that attaches to the truck or other vehicle. The snow plow blocking unit includes a platform that is in communication with a raising and lowering apparatus for raising and lowering the platform. A sideward moving apparatus is also included for moving the platform in the lateral direction. The sideward moving apparatus is in communication with the platform. At least one stop is provided and is positioned forwardly of the platform at a predetermined distance from the platform. The stop cooperates with the truck or other vehicle whereby the truck or other vehicle is positioned a distance from the platform so that when the snow plow is detached from the truck or other vehicle, the connecting bracket of the snow plow is received on the platform by adjusting the raising and lowering apparatus and the sideward moving apparatus. Likewise, when the snow plow is to be attached to the truck or other vehicle the connecting bracket of the snow plow is aligned with the truck or other vehicle by adjusting the raising and lowering apparatus and sideward moving apparatus.

The snow plow can also have an apparatus for receiving the connecting bracket of the snow plow onto the platform which prevents relative movement of the connecting bracket of the snow plow with respect to the platform. This apparatus can include a pair of guides. Each guide can include an elongated shaft and a downwardly extending pin attached at each end of the shaft. The pins are received by a plurality of rings attached to the platform so that one guide is positioned on one side of and adjacent to the connecting bracket of the snow plow and the other guide is positioned on the other side of and adjacent to the connecting bracket of the snow plow. Accordingly, as the platform is moved in the lateral direction the connecting bracket of the snow plow is also moved by the guides.

The snow plow blocking unit can also be provided with a base that includes a rear section and two forwardly positioned legs attached to opposite ends of the rear sections. Each leg is of sufficient width to receive a truck tire and each leg is provided with a stop. The platform is positioned above the rear section and the raising and lowering apparatus and the sidewardly moving apparatus are attached to the rear section.

DESCRIPTION OF THE PREFERRED EMBODIMENT

Figure 1:
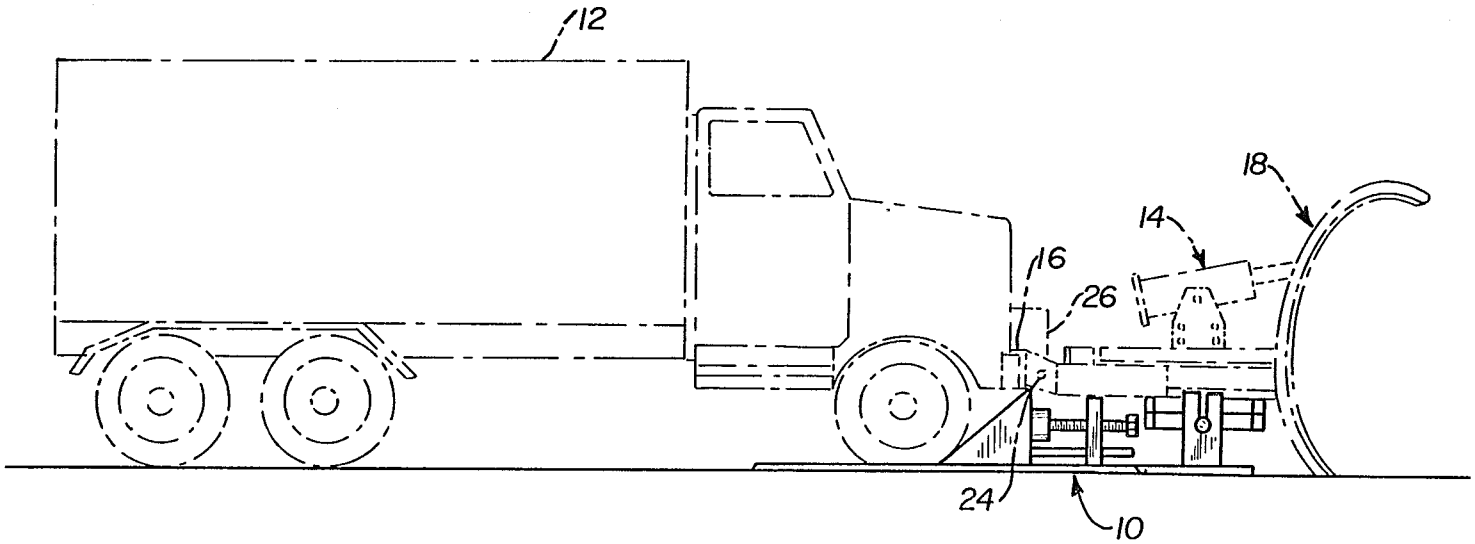
FIG. 1 is a side view of a truck having a snow plow attached thereto positioned on a snow plow blocking unit in accordance with the present invention.

A snow plow blocking unit 10 in accordance with the present invention is shown in FIG. 1 with a typical truck 12 having a standard snow plow 14 attached thereto. The snow plow 14 is attached to a plow frame 16 located on a front end of the truck 12. The snow plow 14, which is shown in more detail in FIG. 2, includes a blade 18 and a structural ring 20 that is attached to the blade 18. A connecting bracket 22 is centrally positioned on the ring 20 and is attached by pins 24 to an appropriate mechanism 26 located on the plow frame 16 of the truck 12 which can raise and lower the snow plow 14 in relation to the truck 12. The snow plow 14 shown in FIG. 1 is in the lowered position with the blade 18 of the snow plow 14 resting on the ground. The bracket 22 of the snow plow 14 is shown in FIG. 2 resting on the snow plow blocking unit 10.

Figure 2:
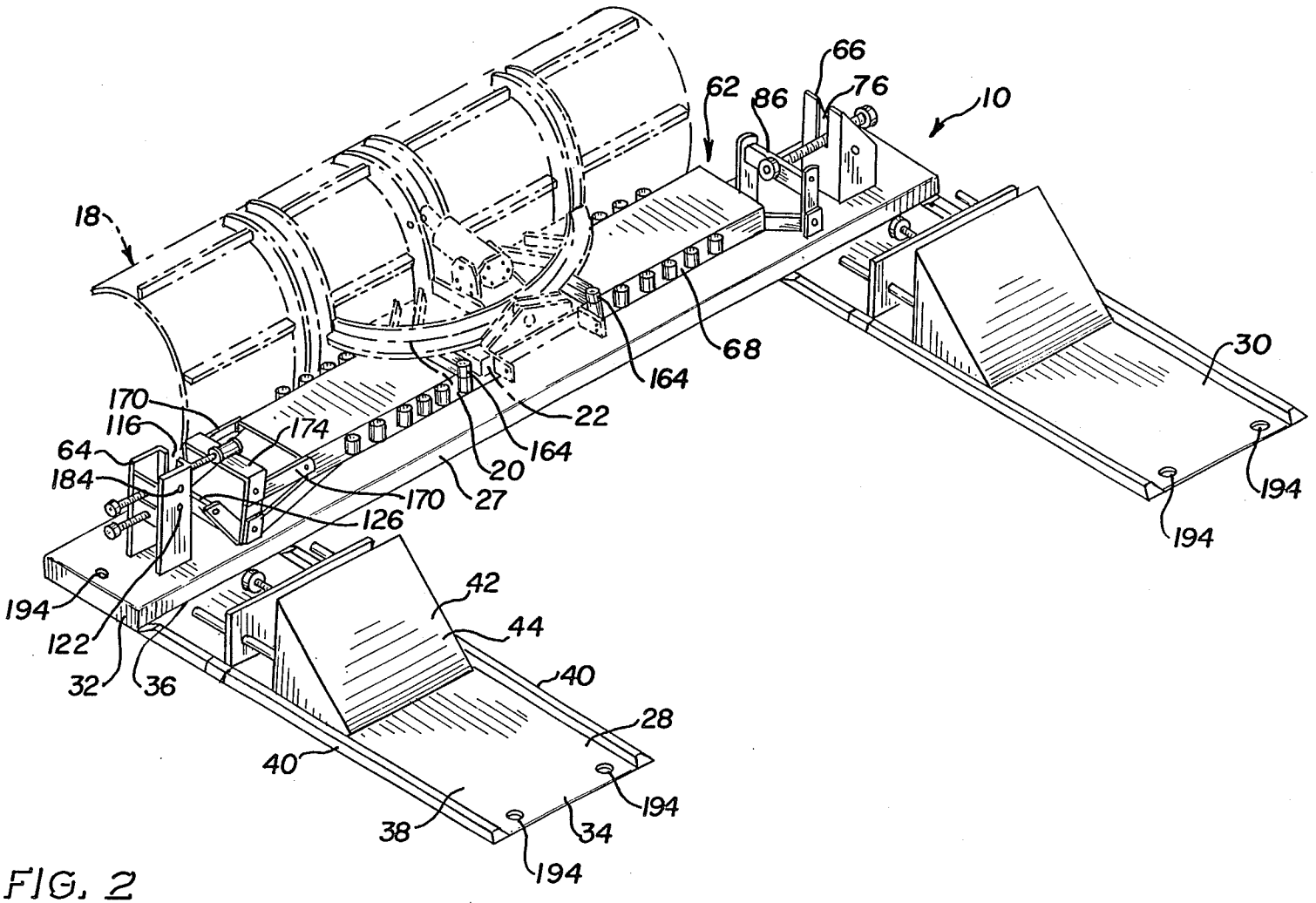
FIG. 2 is a perspective view of the snow plow blocking unit having a snow plow positioned thereon.
Figure 3:
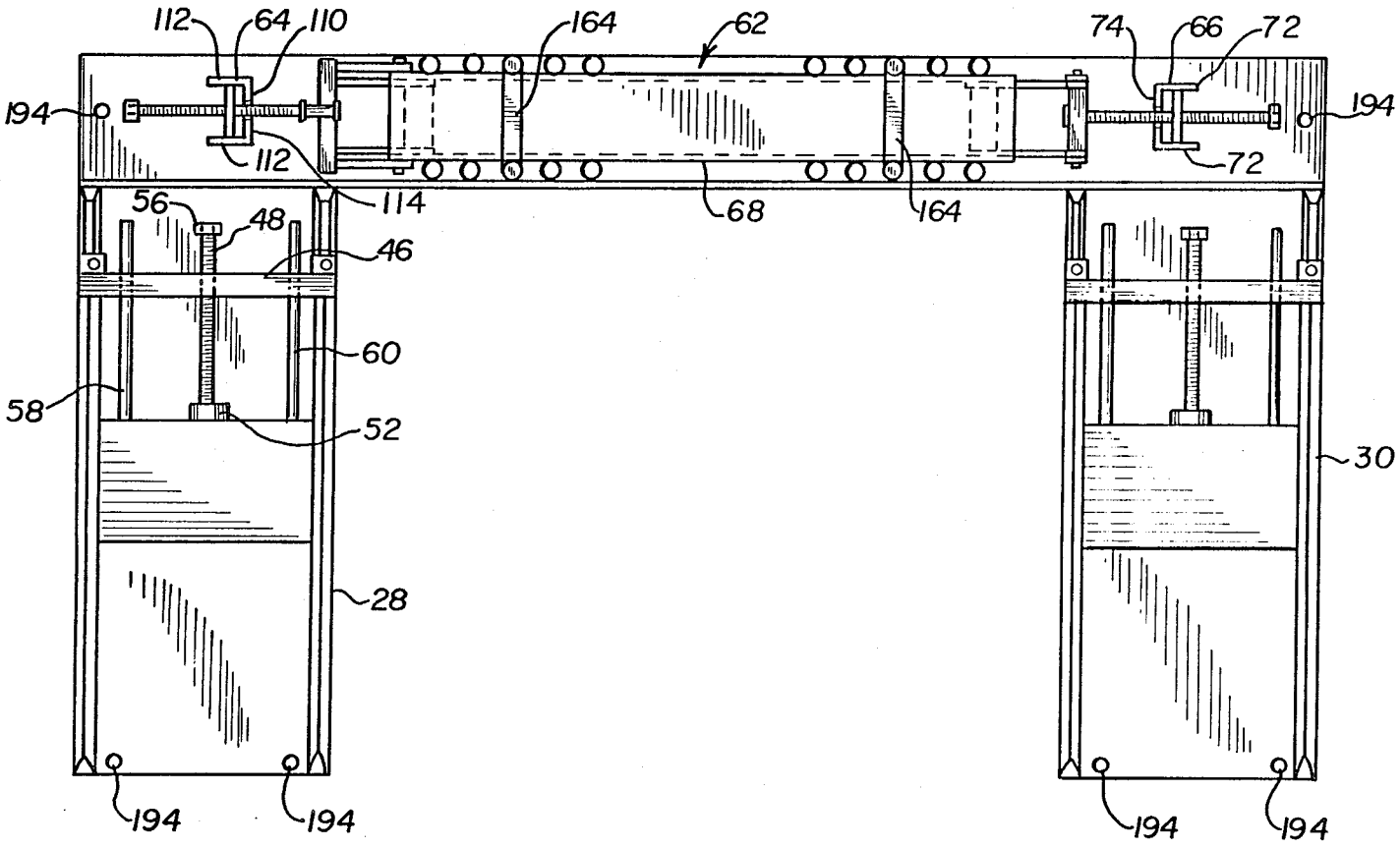
FIG. 3 is a top view of the snow plow blocking unit.

The snow plow blocking unit 10 shown in FIGS. 2 and 3 includes a flat base 27 that is a U-shaped structure having two spaced apart legs 28 and 30 in parallel relation to each other and are attached to and forwardly of a rear section 32. Legs 28 and 30 are of sufficient width to receive a standard truck tire and legs 28 and 30 are sufficiently spaced apart so that a front right tire and left front tire of a truck can be received by legs 28 and 30.

Legs 28 and 30 are exactly the same design, accordingly, leg 28 will be described with like reference numerals referring to like parts of legs 28 and 30. Leg 28 has a front edge 34 and an oppositely positioned rear edge 36 which is attached to the rear section 32. A substantially flat center portion 38 extends rearwardly from the front edge 34 to the rear edge 36. The width of the center portion 38 is greater than that of a truck tire. Two raised sections 40 also extend rearwardly along opposite sides of the center portion 38 of leg 28. Accordingly, raised sections 40 act as a tire guide.

Figure 4:
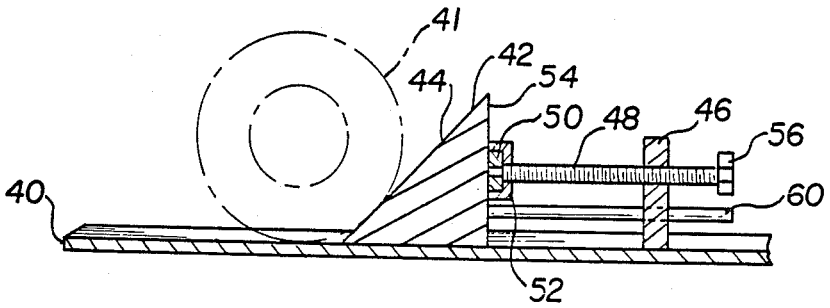
FIG. 4 is a side view partially in section of a leg and stop used in the snow plow blocking unit shown in FIG. 3.

A retractable stop 42, which is shown in more detail in FIG. 4, rests on the center portion 38 of leg 28. The stop 42 has a width approximately equal to the width of the center portion 38 and is also received between raised sections 40 of leg 28. The stop 42 is in the shape of a triangular wedge, although any shape sufficient of stopping a tire 41 will do, and has a front face 44 positioned adjacent to the front edge 34 and extends upwardly and rearwardly at about a 45 degree angle as measured from the center portion 38 of leg 28.

A rectangular-shaped adjusting plate 46 is positioned rearwardly of the stop 42 and is attached to the center portion 38 of leg 28. The adjusting plate 46 has a threaded bore therethrough and threadably receives an adjusting rod 48. An axis passing through the bore of the adjusting plate 46 and the adjusting rod 48 is substantially parallel to leg 28. The adjusting rod 48 has a circular end piece 50 welded to a forward end of the adjusting rod 48. The end piece 50 has a diameter greater than that of the adjusting rod 48.

A bearing cup 52 is mounted to a rear vertical face 54 of the stop 42. The rear face 54 of the stop 40 faces the adjusting plate 46. The bearing cup 52 is cylindrically-shaped and has an open top and a substantially closed bottom. The bottom of the bearing cup 52 has a centrally located bore therethrough of sufficient diameter to receive the adjusting rod 48, but has a smaller diameter than the end piece 50 attached to the adjusting rod 48. The internal diameter of the bearing cup 52 is sufficient to receive the end piece 50. The open end of the bearing cup 52 is preferably welded to the rear face 54 of the stop 42, accordingly, in this arrangement the adjusting rod 48 is pivotally mounted to the rear face 54 of the stop 42 whereby the adjusting rod 48 can only rotate about an axis passing lengthwise through the adjusting rod 48 with respect to the stop 42.

A hexagonal nut 56 is welded to the rearward end of the adjusting rod 48 so that a standard wrench fitting can receive the hexagonal nut 56.

Two guide rods 58 and 60 are also welded to the rear face 54 of the stop 42. Guide rod 58 is sidewardly adjacent to the adjusting rod 48 and extends rearwardly towards the rear edge 36 of leg 28. Guide rod 58 is slideably received by a bore located in the adjusting plate 46. Likewise, guide rod 60 is located on the opposite side of and is sidewardly adjacent to the adjusting rod 48 and guide rod 60 extends rearwardly towards the rear edge 36 of leg 28.

Accordingly, the stop 42 can be moved forwardly or rearwardly by rotating the adjusting rod 48 clockwise or counterclockwise. Guide rods 58 and 60 help guide the stop 42 in the forward and reverse direction and minimize the possibility of the stop 42 becoming jammed between the raised sections 40 of leg 28. The adjustment of stop 42 is not limited by the above described arrangement and accordingly any apparatus that can move the stop 42 in a forward or reverse direction can be used.

Figure 5:
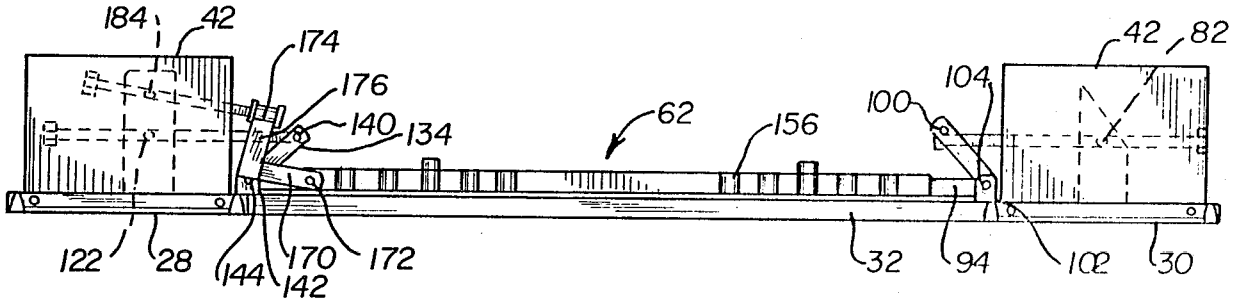
FIG. 5 is a front view of the snow plow blocking unit.
Figure 6:
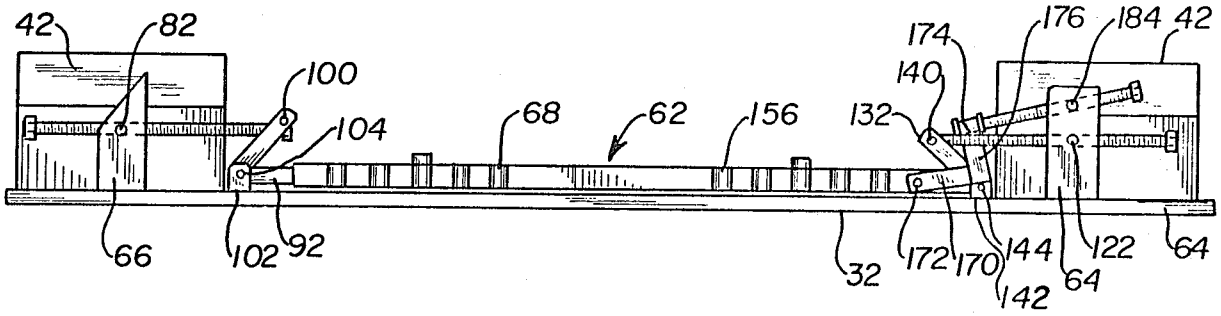
FIG. 6 is a rear view of the snow plow blocking unit.

The rear section 32 of the base 27 is attached to the rear edges 36 of legs 28 and 30 by bolting, welding or the like. An adjustment unit 62 shown in FIGS. 5 and 6 is positioned onto the rear section 32. Preferably, the adjustment unit 62 includes a two axis adjustment unit 64 positioned behind leg 28, a one axis adjustment unit 66 positioned behind leg 30 and a platform 68 that extends between and is in communication with the two axis adjusting unit 64 and the one axis unit 66.

Figure 7:
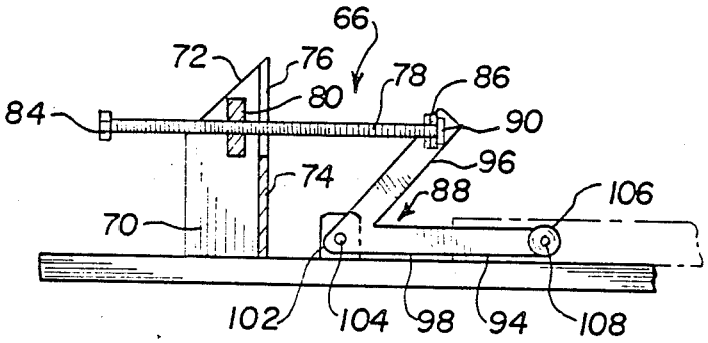
FIG. 7 is a side view partially in section of the one axis adjustment unit in a lowered position used in the snow plow blocking unit shown in FIG. 3.
Figure 8:
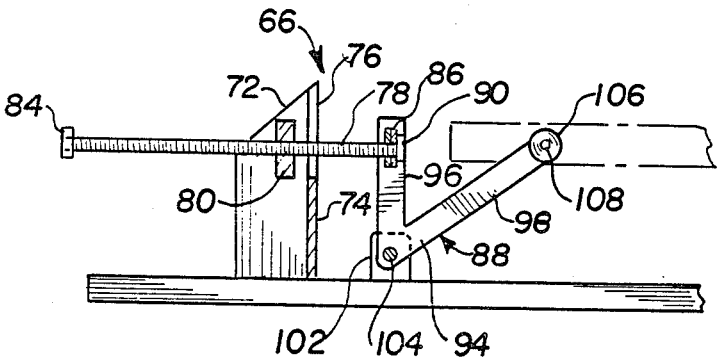
FIG. 8 is a side view partially in section of the one axis adju stment unit in a raised position used in the snow plow blocking unit shown in FIG. 3.

The one axis adjustment unit 66, which is shown in FIGS. 7 and 8, can include any apparatus that can raise and lower the platform 68 with respect to the base 27, but preferably includes a three-sided channel 70 having two tetrahedral-shaped side faces 72 and a planar front face 74. The three-sided channel 70 of the one axis adjustment unit 66 is mounted to the rear section 32 of base 27 typically by welding. The planar front face 74 of the three-sided channel 70 faces inwardly towards the two axis adjustment unit 64. The planar front face 74 of the three-sided channel 70 has an upward facing open-ended slot 76. A threaded shaft 78 is received in the slot 76 of the planar front face 74 of the three-sided channel 70. A rectangular block 80 is received in the three-sided channel 70 and is pivotally attached to an upper portion of the tetrahedral-shaped sides 72 of the three-sided channel 70 by pivot pins 82 so that the block 80 can rotate about an axis parallel to the axis passing through the adjusting rod 48 located on leg 28. The block 80 also has a threaded bore therethrough which is adjacent to the slot 76 located on the planar front face 74 of the three-sided channel 70. The bore of the block 80 threadably receives the threaded shaft 78. A hexagonal nut 84 is welded to an end of the threaded shaft 78. The hexagonal nut 84 is adjacent to the block 80 and is positioned furthest away from the two axis adjustment unit 64.

An end of the threaded shaft 78 opposite to the hexagonal nut 84 is pivotally attached to a cross member 86 of a riser assembly 88. More particularly, the cross member 86 has an unthreaded bore therethrough that slideably receives the threaded shaft 78. A circular plate 90 that has a diameter larger than the bore in the cross member 86 is mounted to the end of the threaded shaft 78 that is opposite the hexagonal nut 84, so that the cross member 86 is adjacent to the plate 90 and rests thereon. The threaded shaft 78 also can rotate about an axis passing through the threaded shaft 78.

The riser assembly 88 also includes two V-shaped brackets 92 and 94. Each V-shaped bracket 92 and 94 includes a first arm 96 which represents the first segment of the "V" and a second arm 98 which represents the second segment of the "V". Bores are provided on the V-shaped brackets 92 and 94 near a top portion of the first arm 96, near a top portion of the second arm 98 as well as at the base of the "V" where the first arm 96 and the second arm 98 intersect to form the "V" shape.

The cross member 86 is pivotally attached at opposite ends to V-shaped brackets 92 and 94. More particularly, pivot pins 100 are attached to the opposite ends of the cross member 86 and are received by the bores located in the top portions of the first arms 96 of the V-shaped brackets 92 and 94. Accordingly, the cross member 86 can rotate about an axis passing through the pivot pins 100 which is parallel to the axis passing through the adjustment rod 48 located on leg 28.

The base of the "V" of V-shaped bracket 92 is pivotally attached to a tab 102 by a pivot pin 104 which is also received by the bore at the base of the "V" of the V-shaped bracket 92. Tab 102 is welded to the rear section 32 of the base 27. Likewise, the base of the "V" of the V-shaped bracket 94 is pivotally attached to a tab 102 by a pivot pin 104 which is also received by the bore at the base of the "V" of the V-shaped bracket 94. Tab 102 is welded to the base 27.

Finally, the riser assembly 88 includes a cylindrically-shaped slide 106 received between the second arms 98 of the V-shaped brackets 92 and 94. The slide 106 is attached to the V-shaped brackets 92 and 94 by pins 108 received by the bores in the second arms 98 of V-shaped brackets 92 and 94. Accordingly, as shown in FIGS. 7 and 8, when the threaded shaft 78 travels in the direction away from or towards leg 28 the riser assembly 88 rotates about an axis passing through pivot pins 104, which is parallel to the axis passing through the adjusting rod 48 located on leg 28. Furthermore, as shown in FIG. 7, when the threaded shaft 78 travels in the direction towards leg 28 the slide 106 of the riser assembly 88 and in turn the platform 68 move downwardly relative to the rear section 32 of the base 27 and as shown in FIG. 8 when the threaded shaft 78 travels in the direction away from leg 28 the slide 106 of the riser assembly 88 and in turn the platform 68 move upwardly relative to the rear section 32 of the base 27.

Figure 9:
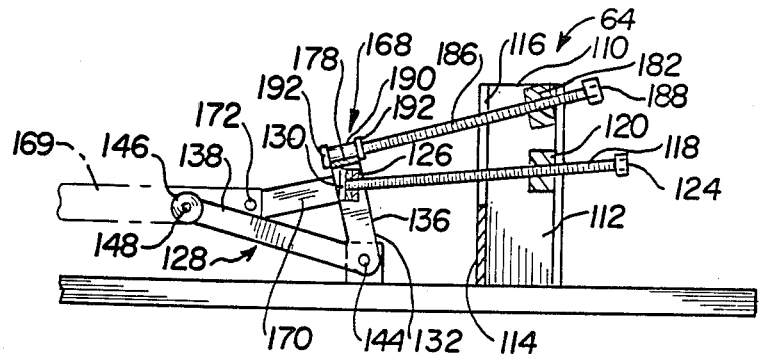
FIG. 9 is a side view partially in section of the two axis adjustment unit in a lowered position used in the snow plow blocking unit shown in FIG. 3.
Figure 10:
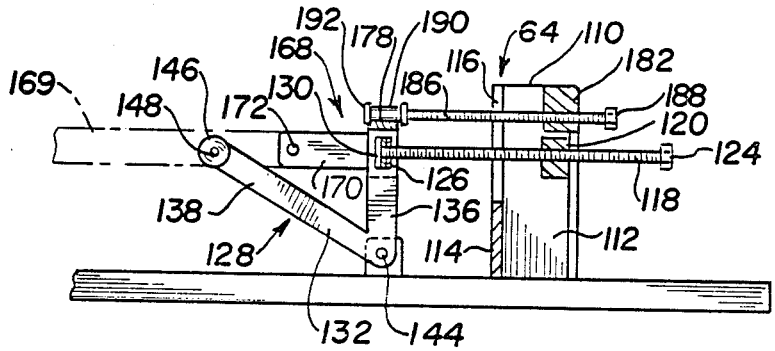
FIG. 10 is a side view partially in section of the two axis adjustment unit in a raised position used in the snow plow blocking unit shown in FIG. 3.

The two axis adjustment unit 64 which is shown in FIGS. 9 and 10 is positioned on the opposite side of the rear section 32 of the base 27 from the one axis adjustment unit 66. The two axis adjustment unit 64 can include any apparatus that can raise, lower and laterally move the platform with respect to the base 27, but preferably includes a three sided C-shaped channel 110 defined by two side faces 112 and a planar front face 114. The C-shaped channel 110 of the two axis adjustment unit 64 is mounted to the rear section 32 of the base 27 typically by welding. The front face 114 of the C-shaped channel 110 faces inwardly towards the one axis adjustment unit 66. The front face 114 of the channel 110 has an upward facing open-ended slot 116. A threaded shaft 118 is received in the slot 116 of the front face 114 of the C-shaped channel 110. A rectangular block 120 is received in the C-shaped channel 110 and is pivotally attached to a middle portion of the side faces 112 of the C-shaped channel 110 by pivot pins 122 so that the block 120 can rotate about an axis parallel to the axis passing through the adjusting rod 48 located on leg 28. The block 120 also has a threaded bore therethrough that is adjacent to the slot 116 located on the front face 114 of the C-shaped channel 110. The bore threadably receives the threaded shaft 118. A hexagonal nut 124 is welded to an end of the threaded shaft 118. The hexagonal nut 124 is adjacent to the block 120 and is positioned furthest away from the one axis adjustment unit 66.

An end of the threaded shaft 118, which is opposite of the hexagonal nut 124, is pivotally connected to a cross member 126 of a second riser assembly 128. More particularly, the cross member 126 has an unthreaded bore therethrough that slideably receives the threaded shaft 118. A circular plate 130 whose diameter is larger than the bore in the cross member 126 is mounted to the end of the threaded shaft 118 that is opposite the hexagonal nut 124 so that the cross member 126 is adjacent to the circular plate 130 and rests thereon. The threaded shaft 118 can also rotate about an axis passing through the threaded shaft 118.

The riser assembly 128 also includes two V-shaped brackets 132 and 134. Each V-shaped bracket 132 and 134 includes a first arm 136 which represents the first segment of the "V" and a second arm 138 which represents the second segment of the "V". Bores are provided on the V-shaped brackets 132 and 134 near a top portion of the first arm 136, near a top portion of the second arm 138 as well as at the base of the "V" where the first arm 136 and the second arm 138 intersect to form the "V" shape.

The cross member 126 is pivotally attached at opposite ends to V-shaped brackets 132 and 134. More particularly, pivot pins 140 are attached to the opposite sides of the cross member 126 and are received by the bores located in the top portions of first arms 136 of V-shaped brackets 132 and 134. Accordingly, the cross member 126 can rotate about an axis passing through the pivot pins 140 which is parallel to the axis passing through the adjusting rod 48 located on leg 28.

The base of the "V" of the V-shaped bracket 132 is pivotally attached to a tab 142, which has a bore therethrough, by a pivot pin 144 which is also received by the bore at the base of the "V" of V-shaped bracket 132. Tab 142 is welded to the rear section 32 of the base 27. Likewise, the base of the "V" of the V-shaped bracket 134 is pivotally attached to tab 142 by a pivot pin 144 which is received by the bore at the base of the "V" of V-shaped bracket 134. Tab 142 is welded to the rear section 32 of the base 27.

Finally, the riser assembly 128 also includes a cylindrically-shaped slide 146 received between the second arms 138 of V-shaped brackets 132 and 134. The slide 146 is attached to V-shaped brackets 132 and 134 by pins 148 received by the bores in the upper portions of the second arms 138 of the V-shaped brackets 132 and 134. Accordingly, as shown in FIGS. 9–10, when the shaft 118 travels in the direction away from or towards leg 30 the riser assembly 128 rotates about an axis passing through pivot pins 144, which is parallel to the axis passing through the adjusting rod 48 located on leg 28. Furthermore, as shown in FIG. 9, when the threaded shaft 118 travels in the direction toward leg 30 the slide 146 of the riser assembly 128 and in turn the platform 68 moves downwardly relative to the rear section 32 of the base 27 and as shown in FIG. 10, when the threaded shaft 118 travels in the direction away from leg 30 the slide 146 of the riser assembly 128 moves upwardly relative to the rear section 32 of the base 27.

Figure 11:
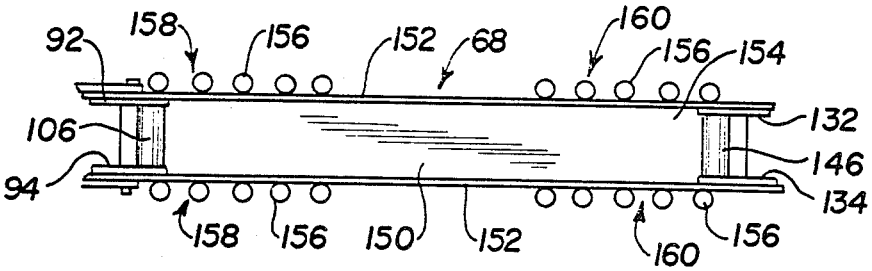
FIG. 11 is a bottom view of the platform and riser assemblies used in the snow plow blocking unit shown in FIG. 3.
Figure 12:
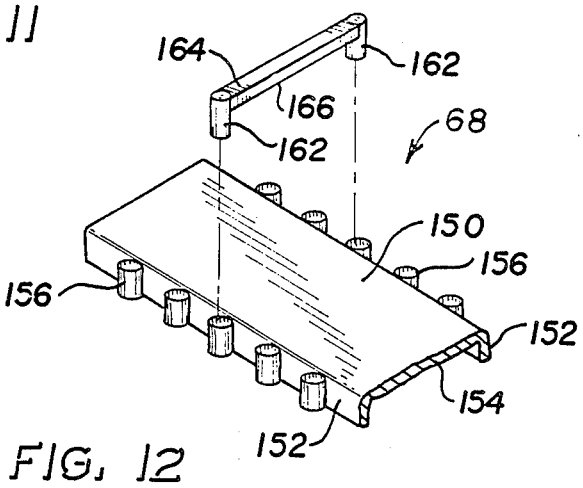
FIG. 12 is a perspective view partially in section of the platform and guides used in the blocking unit shown in FIG. 3.

The platform 68 is a C-shaped channel having a substantially flat top 150 and two sides 152 that extend downwardly. The platform 68 extends substantially along the rear section 32 of the base 27 between the two axis adjustment unit 64 and the one axis adjustment unit 66. A bottom surface 154 of the top 150 of the platform 68 rests on the slides 106 and 146. V-shaped brackets 92, 132, and 94 and 134 are adjacent to, rest against and are in sliding engagement with the respective inside surfaces of sides 152 of the platform 68 as shown in FIG. 11.

Accordingly, as riser assemblies 88 and 128 are raised or lowered the appropriate end of the platform 68 which rests on that particular riser assembly 88 or 128 is likewise raised or lowered. Furthermore, since the riser assemblies 88 and 128 pivot about pivot pins 104 and 144 the respective slides 106 and 146 also move in a sidewardly direction relative to the base 27 as well as in the vertical direction when the platform 68 is raised or lowered. V-brackets 92, 94, 132, and 134 of the risers assemblies 88 and 128, respectively, slide, along the inside surfaces of sides 152 of the platform 68 when the platform is raised or lowered.

A plurality of hollow rings 156 are mounted along the sides 152 of the platform 68. The orientation of the rings 156 is such that an axis passing through the rings 156 extends in the vertical direction. The rings 156 are positioned in two groups 158 and 160. In this particular embodiment each group of rings 158 and 160 has ten rings 156 - five rings 156 on each side 152 of the platform 68. The rings 156 on one side 152 of the platform 68 are directly across from the rings 156 on the other side 152 of the platform 68 for each group of rings 158 and 160.

Guide pins 162, which are attached to a guide 164, are slideably received by a pair of rings 156 positioned on opposite sides 152 of the platform 68. More particularly, the guide 164 has an elongated shaft 166 that has two ends. The length of the guide 164 is approximately equal to the width of the platform 68. One guide pin 162 extends downwardly from each end of the shaft 166 of the guide 164. Two guides 164 are included with each snow plow blocking unit 10 - one guide 164 for each group of rings 158 and 160.

A lateral movement assembly 168, which is shown in FIGS. 9 and 10, is part of the two axis adjustment unit 64 and is mounted to an end 169 of the platform 68 that is closest to the two axis adjustment unit 64. The lateral movement assembly 168 includes two elongated rectangular-shaped brackets 170 positioned near the end 169 of the platform 68. One bracket 170 pivotally attached to an outer surface of one side 152 of the platform 68 and the other bracket 170 is pivotally attached to an outer surface of the other side 152 of the platform 68. Brackets 170 are pivotally attached to the platform 68 by pivot pins 172 so that brackets 170 can rotate about an axis that is parallel to the axis passing through the adjusting rod 48 located on leg 28. Brackets 170 extend away from leg 30.

A C-shaped bracket 174 having downwardly extending sides 176 and a flat top 178 is rigidly mounted to the ends of brackets 170 which are furthest away from leg 30. The top 178 of the C-shaped bracket 174 is positioned above brackets 170 and one downwardly extending side 176 of C-shaped bracket 174 is attached to an outer surface of one of the brackets 170 and the other downwardly extending side 176 of the C-shaped bracket 174 is attached to an outer surface of the other bracket 170. The downwardly extending sides 176 of the C-shaped bracket 174 are rigidly attached to the brackets 170 by fasteners or welding.

Also included in the lateral movement assembly 168 is a rectangular block 182 which is received in the C-shaped channel 110 of the two axis adjustment unit 64. Block 182 is pivotally attached to a top portion of the C-shaped channel 110 above block 120 of the two axis adjustment unit 64. Block 182 is pivotally attached to the side faces 112 of the C-shaped channel 110 by pivot pins 184 so that block 182 can rotate about an axis parallel to the axis passing through the adjusting rod 48 located on leg 28. Block 182 also has a threaded bore therethrough that is adjacent to the slot 116 located on the front face 114 of the C-shaped channel 110. The bore threadably receives a threaded shaft 186. The threaded shaft 186 is also received by slot 116 of the front face 114 of the C-shaped channel 110. The threaded shaft 186 is also positioned above the threaded shaft 118. A hexagonal nut 188 is welded to an end of the threaded shaft 186 that is adjacent to both the block 182 and the hexagonal nut 124 located on the threaded shaft 118.

An end of the threaded shaft 186 is pivotally connected to the upper surface of the top 178 of the C-shaped bracket 174. More particularly, a hollow cylinder 190 that is open at both ends is welded onto the top surface of the top 178 of the C-shaped bracket 174 and slideably receives the threaded shaft 186 therethrough. Two circular plates 192 are rigidly attached to the threaded shaft 186. One of the plates 192 is adjacent to and in contact with one end of the cylinder 190 and the other plate 192 is adjacent to and in contact with the other end of the cylinder 190. Accordingly when the threaded shaft 186 is rotated in one direction the platform 68 is pulled towards the two axis adjustment unit 64 and when the shaft 186 is rotated in the opposite direction the platform 68 is pushed toward the one axis adjustment unit 66. The platform 68 is guided by the V-shaped brackets 92, 94, 132 and 134 of the riser assemblies 88 and 128 and the sides 152 of the platform 68.

Bores 194 may be provided at various positions on the base 27 such as on legs 28 and 30 and the rear section 32. These bores 194 are adapted to receive spikes so that the base 27 is securely fastened to the ground.

In operation, the snow plow blocking unit 10 functions as follows. Typically the connecting bracket 22 of the snow plow 14 rests on the platform 68 when it is unattached from a truck 12. The blade 18 of the snow plow 14 is positioned rearwardly from the snow plow blocking unit 10 and rests on the ground. The guides 164 are positioned adjacent to each side of the connecting bracket 22 and are received in the appropriate rings 156 located on the platform 68. A portion of the connecting bracket 22 of the snow plow 14 extends forwardly from the platform 68 and is connected to the mechanism 26 for raising and lowering the snow plow 14 which is attached to the plow frame 16 of the truck 12 when the snow plow 14 is in operation.

The truck 12 drives onto the snow plow blocking unit 10 with one front tire received by leg 28 and the other front tire received by leg 30. The truck 12 moves forwardly until its front tires meet stops 42. Stops 42 are set at a proper distance from the platform 68 so that the mechanism 26 located on the plow frame 16 of truck 12 is at a proper distance from the platform 68 to receive the connecting bracket 22 of the snow plow 14. Stops 42 are adjustable in the forward and rearward direction by using a wrench having a hexagonal head which can receive the hexagonal nuts 56 located on the adjusting rods 48. Accordingly the wrench is turned to rotate the adjusting rod 48 either in the clockwise or counterclockwise direction which in turn moves the stop 42. This enables the snow plow blocking unit 10 to accept a wide variety of different size trucks 12 and snow plows 14.

Once the truck 12 is properly positioned onto the snow plow blocking unit 10 the connecting bracket 22 of the snow plow 14 can further be aligned onto the mechanism 26 located on the fender 16 of the truck 12 in the lateral and the vertical direction. Each side of the platform 68 can be raised independently of the other. This is important in case the plow frame is misaligned.

The same wrench fitting used to adjust the stops 42 can be fitted over hexagonal nut 84 of the threaded shaft 78 and rotated to raise or lower the end of the platform adjacent leg 30. Likewise the same wrench fitting used to adjust the stops 42 can be fitted over hexagonal nut 124 of the threaded shaft 118 and rotated to raise or lower the end of the platform adjacent to leg 28. Furthermore, the lateral displacement of the platform 68 can be adjusted in a similar manner. The same wrench fitting used to adjust the stops 42 can be fitted over hexagonal nut 188 and rotated to move the platform 68 and in turn the connecting bracket 22 of the snow plow 14 in the lateral direction, i.e. closer to leg 28 or closer to leg 30.

Thus, once an operator adjusts the connecting bracket 22 of the snow plow 14 to a proper orientation with the raising and lowering mechanism 26 located on the fender 16 of the truck 12, the snow plow can be fastened thereto by pins 24. The snow plow 14 is then raised relative to the ground and the platform 68. The truck 12 reverses direction and leaves the snow plow blocking unit 10. This can be accomplished in a short period of time and with only one operator. The above-described procedure is reversed when the snow plow 14 is disconnected from the truck 12.

The snow plow blocking unit 10 does not need to be dedicated to one truck 12/snow plow 14 arrangement. The stops 42 and the platform 68 can easily be adjusted to connect one particular snow plow 14 to different sized trucks 12 or different sized snow plows 14 to one particular size truck.

Having described the presently preferred embodiment of the present invention, it is to be understood that it may be otherwise embodied within the scope of the appended claims.

I claim:

1. A snow plow blocking unit for fastening and removing a snow plow from a truck or other vehicle, the snow plow of the type having a connecting bracket that attaches to the truck or other vehicle, said snow plow blocking unit comprising:

a platform;

a raising and lowering apparatus in communication with said platform for raising and lowering said platform;

a sideward moving apparatus in communication with said platform for moving said platform in the lateral direction; and a stop positioned forwardly of said platform and positioned a predetermined distance from said platform, said stop cooperating with the truck or other vehicle whereby the truck or other vehicle is positioned a predetermined distance from said platform so that when the snow plow is detached from the truck or other vehicle, the connecting bracket of the snow plow is received on said platform by adjusting said raising and lowering apparatus and said sideward moving apparatus and when the snow plow is to be attached to a truck or other vehicle the connecting bracket is aligned with the truck or other vehicle by adjusting said raising and lowering apparatus and said sideward moving apparatus.

2. The snow plow blocking unit of claim 1 further comprising:

means for receiving the connecting bracket of the snow plow onto said platform that prevent relative movement of the connecting bracket of the snow plow with respect to the platform.

3. The snow plow blocking unit of claim 1 further comprising:

a base having a rear section and a forward section, where said platform, said raising and lowering apparatus and said sideward moving apparatus are attached to said rear section of said base and said stop is attached to said forward section of said base.

4. The snow plow blocking unit of claim 3 wherein said base includes a rear section and two legs attached to opposite ends of said rear section, each of said legs is of sufficient width to receive a truck tire and both of said legs are sufficiently spaced apart to receive a truck's frontmost passenger side tire and a truck's frontmost driver's side tire, respectively, each of said legs having a stop attached thereto, and said platform, raising and lowering apparatus and sidewardly moving apparatus are attached to said rear section.

5. A snow plow blocking unit for fastening and removing a snow plow from a truck or other vehicle, the snow plow of the type having a connecting bracket that attaches to the truck or other vehicle, said snow plow blocking unit comprising:

a base having a rear section and two forwardly extending spaced apart legs attached thereto;

a platform positioned above said rear section of said base;

a raising and lowering apparatus for raising and lowering said platform, said raising and lowering apparatus attached to said rear section of said base and in communication with said platform, a sideward moving apparatus for moving said platform in the lateral direction, said sideward moving apparatus attached to said rear section of said base and in communication with said platform;

two stops, one of said stops adjustably attached to one of said legs of said base and the other of said stops adjustably attached to the other of said legs of said base whereby said legs receive the tires of a truck or other vehicle which in turn come in contact with said stops, said stops positioned forwardly of said platform and spaced a distance from said platform so that the connecting bracket of a snow plow can be received onto said platform.

6. The snow plow of claim 5 further comprising means for receiving the connecting bracket of the snow plow onto said platform that prevent relative movement of the connecting bracket of the snow plow with respect to said platform.

7. The snow plow of claim 6 wherein said means for receiving the connecting bracket of the snow plow onto said platform includes a pair of guides, each of said guides includes:

an elongated shaft having two ends; and two pins, one of said pins depends from one of the ends of said elongated shaft and the other of said pins depends from the other end of said pin, and a plurality of hollow rings attached to said platform adapted to receive said pins of said rings, an upper edge of each of said rings positioned equal to or below an upper surface of said platform, said rings grouped into a plurality of pairs where one said ring of said pair of rings is positioned on a forward side of said platform and the other of said pair of rings is positioned on a rearward side of said platform and said pairs of rings positioned on opposite ends of said platform whereby one of said guides is received by one of said pairs of said rings on one end of said platform and the other of said guides is received by another said pairs of said rings on the other end of said platform so that the connecting bracket of the snow plow is adjacent to and received between said guides.

8. The snow plow blocking unit of claim 5 wherein each of said legs has a raised section that extends toward said rear section along each side of said legs, whereby said raised section guides the tires of the truck or other vehicle to said stop.

9. The snow plow blocking unit of claim 5 wherein said platform has a flat top and two downwardly extending sides;

said raising and lowering apparatus includes two riser assemblies, one of said riser assemblies in cooperation with one end of said platform and the other of said riser assemblies in cooperation with the other end of said platform, each of said riser assemblies includes:

a rod in sliding contact with a bottom surface of said platform and said rod received between said downwardly extending sides;

a bracket attached to said rod, a central portion of said bracket pivotally mounted to said base at a pivot point, means to rotate said bracket about the pivot point whereby when said bracket is rotated in one direction about the pivot point said platform is raised and when said bracket is rotated in the other direction about the pivot point said platform is lowered.

10. The snow plow blocking unit of claim 8 wherein each of said stops is in a shape of a triangular wedge having a front face extending upwardly and outwardly towards said rear section of said base and said stop is received between said raised sections located on said leg and means for adjusting said stop in the rearward and forward direction.

11. The snow plow blocking unit of claim 10 wherein said means for adjusting said stop includes:

a threaded shaft pivotally mounted to a rear face of said triangular wedge; and a plate mounted to said leg, said plate having a threaded bore therethrough, said plate positioned rearwardly of said triangular wedge, said threaded shaft received by said threaded bore of said plate whereby when said shaft is rotated in one direction said triangular wedge is urged in the forward direction and when said shaft is rotated the opposite direction said stop is urged in the rearward direction.

12. The snow plow blocking unit of claim 9 wherein each of said riser assemblies includes:

a rod in sliding contact with a bottom surface of said platform, said rod has two ends, each end of said rod adjacent to one of said sides of said platform;

two brackets, each of said brackets having two ends, one end of one of said brackets attached to one end of said rod and one end of the other of said brackets attached to the other end of said rod, each of said brackets pivotally mounted between the ends of said brackets to said base;

a cross member attached to both of said brackets at the ends opposite said rod, a threaded shaft having two ends, pivotally attached at one of the ends to said cross member; and a block having a threaded bore therethrough pivotally mounted to said base, said threaded bore receives said threaded shaft whereby when said threaded shaft is rotated in one direction said brackets are rotated raising said rod attached thereto and in turn raising said platform and when said threaded shaft is rotated in the opposite direction said brackets are rotated lowering said rod attached thereto and in turn lowering said platform.

13. The snow plow blocking unit of claim 12 wherein said brackets are V-shaped having a first arm that represents the first segment of the "V" and a second arm that represents a second segment of the "V", said cross member attached to said first arm of said bracket and said rod attached to said second arm and said bracket pivotally attached to said base where said first arm and said second arm intersect to form the "V".

14. The snow plow blocking unit of claim 5 wherein said sideward moving apparatus includes:

a bracket pivotally mounted to one end of said platform, a threaded shaft pivotally mounted to said bracket, a block having a threaded bore that receives said threaded shaft, said block mounted to said base whereby when said threaded shaft is rotated in one direction the platform moves sidewardly toward one of said legs and when said shaft is rotated in the other direction the platform moves sidewardly toward the other of said legs.

* * * * *